US010037650B2

(12) United States Patent
Hendricks et al.

(10) Patent No.: US 10,037,650 B2
(45) Date of Patent: Jul. 31, 2018

(54) GAMING SYSTEM AND A METHOD OF GAMING

(71) Applicant: Aristocrat Technologies Australia Pty Limited, North Ryde (AU)

(72) Inventors: Bradley Hendricks, Las Vegas, NV (US); Thomas Tuomey, Las Vegas, NV (US)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 13 days.

(21) Appl. No.: 15/274,565

(22) Filed: Sep. 23, 2016

(65) Prior Publication Data

US 2017/0092047 A1 Mar. 30, 2017

Related U.S. Application Data

(60) Provisional application No. 62/232,813, filed on Sep. 25, 2015.

(51) Int. Cl.
*G07F 17/34* (2006.01)
*G07F 17/32* (2006.01)

(52) U.S. Cl.
CPC ..... *G07F 17/3213* (2013.01); *G07F 17/3209* (2013.01); *G07F 17/3225* (2013.01); *G07F 17/3246* (2013.01); *G07F 17/3251* (2013.01); *G07F 17/3267* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 6,832,957 | B2 * | 12/2004 | Falconer | G07F 17/34 463/20 |
| 7,156,741 | B2 * | 1/2007 | Hornik | G07F 17/32 463/30 |
| 7,758,416 | B2 * | 7/2010 | Randall | G07F 17/32 463/20 |
| 9,111,420 | B2 * | 8/2015 | Arora | G07F 17/3258 |
| 9,659,462 | B2 * | 5/2017 | Baerlocher | G07F 17/34 |
| 2002/0045474 | A1 * | 4/2002 | Singer | G07F 17/32 463/20 |
| 2002/0183105 | A1 * | 12/2002 | Cannon | A63F 13/08 463/4 |

(Continued)

*Primary Examiner* — Tramar Harper
(74) *Attorney, Agent, or Firm* — McAndrews, Held & Malloy, Ltd.

(57) ABSTRACT

A gaming system comprising a first base game implementer for implementing a first base game. A selector selects a plurality of first symbols for the first base game. The first symbols are selected from a set of first game symbols for display in a plurality of first display positions. An outcome of the first base game is dependent on the selected first base game symbols. The system implements a second base game and selects a plurality of second symbols from a set of second game symbols for display in a plurality of second display positions. An outcome of the second base game is dependent on the selected second base game symbols. A trigger determiner determines whether a combination of displayed first game symbols and displayed second game symbols satisfies a trigger condition. A game event is implemented in response to the occurrence of a trigger condition.

23 Claims, 10 Drawing Sheets

(56) References Cited

U.S. PATENT DOCUMENTS

| | | | | |
|---|---|---|---|---|
| 2004/0043815 | A1* | 3/2004 | Kaminkow | G07F 17/3244 463/25 |
| 2008/0039175 | A1* | 2/2008 | Tessmer | G07F 17/3262 463/20 |
| 2009/0124325 | A1* | 5/2009 | Wadleigh | G07F 17/3267 463/20 |
| 2009/0197665 | A1* | 8/2009 | Christensen | G07F 17/32 463/20 |
| 2009/0215521 | A1* | 8/2009 | Borissov | G07F 17/3227 463/20 |
| 2010/0004049 | A1* | 1/2010 | Ching | G07F 17/3267 463/20 |
| 2010/0048289 | A1* | 2/2010 | Mitchell | G07F 17/32 463/20 |
| 2010/0173694 | A1* | 7/2010 | Tsuchida | G07F 17/3244 463/20 |
| 2011/0105218 | A1* | 5/2011 | Anderson | G07F 17/32 463/20 |
| 2014/0200066 | A1* | 7/2014 | Joshi | G07F 17/3213 463/20 |
| 2015/0087383 | A1* | 3/2015 | Saunders | G07F 17/34 463/20 |

* cited by examiner

GAMING SYSTEM AND A METHOD OF GAMING

RELATED APPLICATIONS

This application claims priority to U.S. Provisional Patent Application No. 62/232,813 having a filing date of Sep. 25, 2015, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system arranged to randomly display several symbols from a predetermined set of symbols and to determine a game outcome such as a game win based on the displayed symbols.

Such gaming systems may commonly be implemented as a stepper machine provided with reels with each reel carrying several symbols of the set, or a video machine wherein selected symbols are displayed on virtual reels on a graphical display device.

However, while such gaming systems provide users with enjoyment, a need exists for alternative gaming systems in order to maintain or increase player enjoyment.

BRIEF SUMMARY OF THE INVENTION

In accordance with a first aspect of the present invention, there is provided a gaming system comprising:

a first base game implementer for implementing a first base game;

a selector arranged to select a plurality of first symbols for the first base game, the first symbols being selected from a set of first game symbols for display in a plurality of first display positions, and an outcome of the first base game being dependent on the selected first base game symbols;

the system arranged to implement a second base game and select a plurality of second symbols from a set of second game symbols for display in a plurality of second display positions, wherein an outcome of the second base game is dependent on the selected second base game symbols;

the system further comprising a trigger determiner arranged to determine whether a combination of displayed first game symbols and displayed second game symbols satisfies a trigger condition; and the system arranged to implement a game event in response to occurrence of a trigger condition.

In an embodiment, the first game symbols are different from the second game symbols.

In an embodiment, the trigger condition is based on display of a defined symbol combination occurring in the combined outcomes of the first and second base games.

In an embodiment, the trigger condition is based on display of defined symbols at defined display positions of the first and second base games.

In an embodiment, the defined display positions correspond to a scatter pattern.

In an embodiment, each of the plurality of first display positions is associated with one of a plurality of first display position groups, wherein each group comprises two or more of the first display positions.

In an embodiment, each of the plurality of second display positions is associated with one of a plurality of second display position groups, wherein each group comprises two or more of the second display positions.

In an embodiment, each first display position group and each second display position group is associated with a reel having a plurality of display positions.

In an embodiment, at least one first display position group is paired with a second display position group, and the trigger condition is based on a defined first game symbol and/or a defined second game symbol being displayed in at least one of the pairings.

In an embodiment, the trigger condition is based on a defined first game symbol and/or a defined second game symbol being displayed in each of a plurality of display position group pairings.

In an embodiment, when a defined first game symbol and a defined second game symbol are displayed in the same reel pairing, a further trigger condition is satisfied.

In an embodiment, in response to the further trigger condition, the defined first game symbol and the defined second game symbol are replaced with a WILD symbol.

In an embodiment, the game event comprises special game mode that includes implementation of at least one feature game.

In accordance with a second aspect of the present invention, there is provided a method of gaming comprising:

implementing a first base game and a second base game;

selecting a plurality of first symbols for the first base game from a set of first base game symbols and displaying the selected first base game symbols in a plurality of first display positions to obtain a first base game outcome;

selecting a plurality of second symbols for the second base game from a set of second game symbols and displaying the selected second game symbols in a plurality of second display positions to obtain a second base game outcome;

determining whether a combination of displayed first game symbols and displayed second game symbols satisfies a trigger condition; and implementing a game event when the trigger condition is satisfied.

BRIEF DESCRIPTION OF SEVERAL VIEWS OF THE DRAWINGS

In order that the present invention may be more clearly ascertained, embodiments of the present invention will now be described, by way of example only, with reference to the accompanying drawings, in which.

DETAILED DESCRIPTION OF PREFERRED EMBODIMENTS

Figure 1:
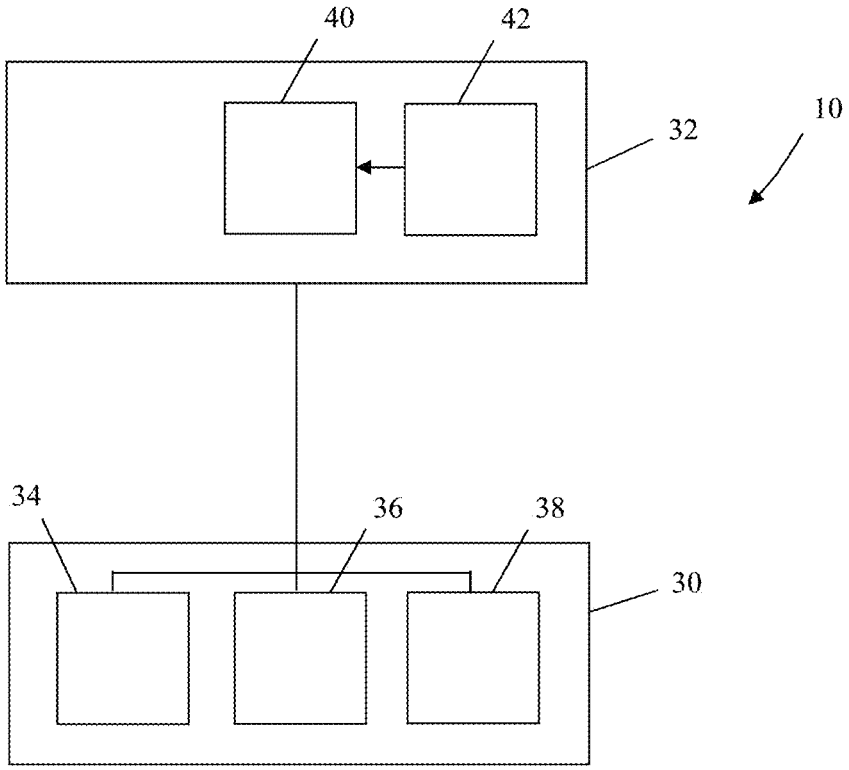
FIG. 1 is a schematic block diagram of components of a gaming system in accordance with an embodiment of the present invention.

The present gaming system operates such that during base game play, a plurality of symbols are randomly selected from a set of symbols and displayed in a corresponding plurality of display positions for. The symbols shown at the display positions are used to determine game outcomes by comparing the displayed symbols with defined winning combinations.

In one conventional type of gaming machine, a display area including 15 display positions is presented to a player with each display position including one symbol. The display positions are arranged in five vertically disposed reels, with each reel corresponding with a display position group, and each reel having three visible display positions. After the reels are spun and subsequently stopped, the display positions show a random selection of symbols.

Generally, with such games, a plurality of win patterns in the form of win lines are defined which extend across the reels and include one display position from each reel. Typically the symbols that are disposed in a win line are compared with winning symbol combinations defined in a pay table so as to determine whether a player of the game should receive an award. For example, if winning symbol combinations are based on poker hands, a particular prize would be awarded if the win line comprises four aces. Other winning symbol combinations and corresponding prizes may also be defined.

Such a game often comprises normal game mode and special game mode. During normal game mode, the displayed symbols are compared with base winning combinations defined in a pay table.

With the present system, a plurality of base games are implemented and each game outcome is evaluated to determine whether a winning outcome exists. If a winning outcome occurs in any of the base games, one or more prizes are awarded to the player.

Special game mode is triggered when a defined outcome occurs across the base games. For example, in an embodiment comprising two base games, the defined outcome may be display of a defined symbol in any of a plurality of defined symbol positions of the first base game or a plurality of defined symbol positions of the second base game.

During special game mode, at least one feature game is implemented, and in this example a plurality of feature games are available.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. The system is of the type including multiple game modes, such as being operable in normal game mode wherein base games are implemented and special game mode wherein a feature game is implemented.

With some such probabilistic games, the set of symbols used during normal game mode include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display along a win line, or are displayed according to defined outcome patterns such as scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

Referring to FIG. 1, a schematic diagram of components of a gaming system 10 in accordance with the present embodiment is shown. The components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game play instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
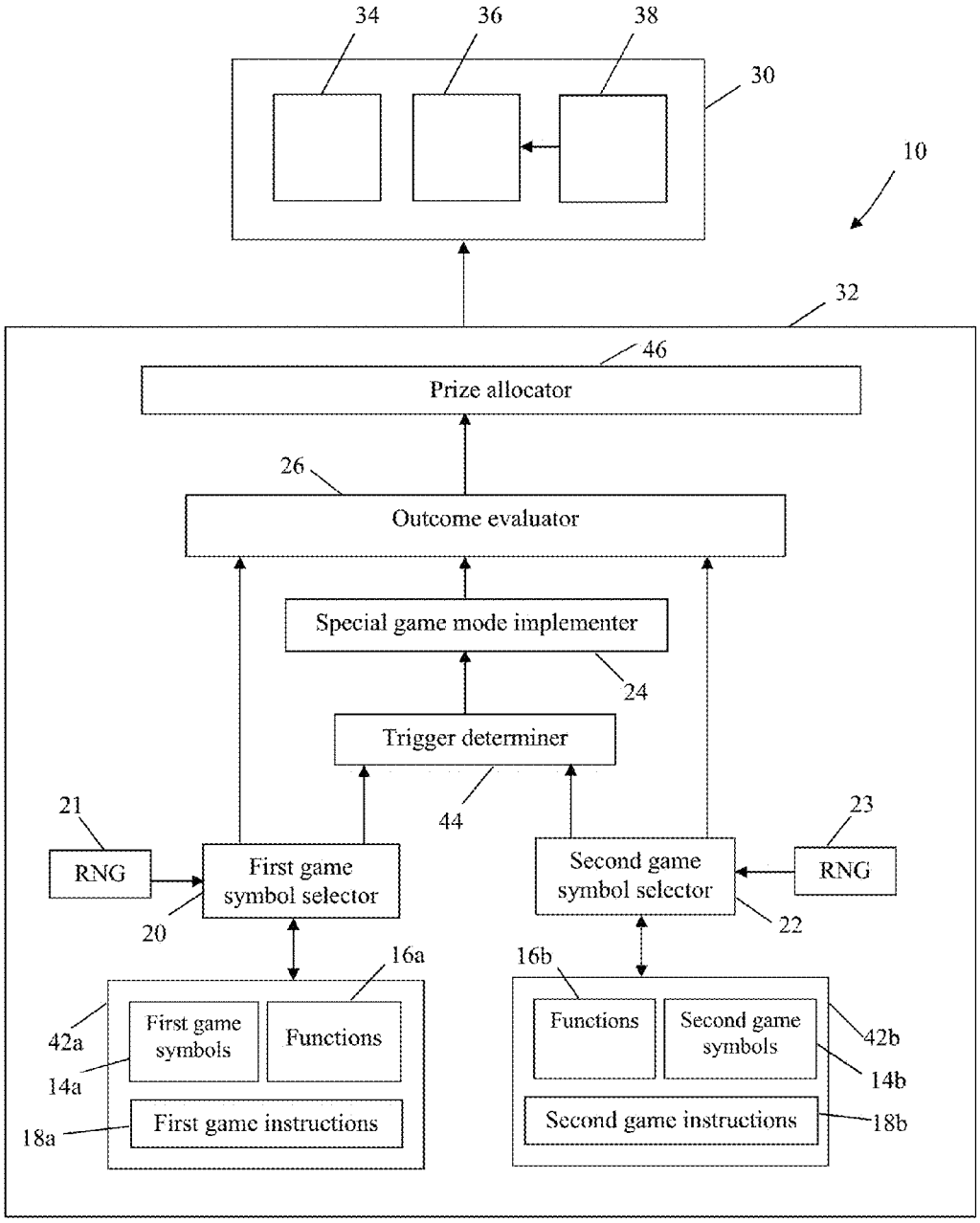
FIG. 2 is a schematic block diagram of functional components of a gaming system in accordance with an embodiment of the present invention.

A functional diagram illustrating operative components of the game controller 32 is shown in FIG. 2.

In this example, the components of the game controller 32 are operable to implement a first base game and a second base game, to determine game outcomes of the first and second base games, to trigger special game mode when a defined outcome occurs across both base games, and to implement at least one feature game when special game mode is triggered.

The game controller 32 includes a first game symbol selector 20 arranged to select several first symbols from available symbols 14*a* associated with the first game. Once selected, the first selected symbols are displayed to a player in a plurality of first display positions.

In an embodiment, each of the plurality of first display positions is associated with one of a plurality of first display position groups, and each first group comprises two or more first display positions. In this example, the plurality of first display position groups are represented by reels, and the game is played by spinning reels containing the first symbols and stopping the reels so as to display at least one first symbol on each reel.

The game controller 32 also comprises a second game symbol selector 22, operable in a similar manner to the first symbol selector 20, to select several second symbols from available second symbols 14*b* associated with the second game, and display the selected second symbols in second display positions.

In an embodiment, each of the plurality of second display positions is associated with one of a plurality of second display position groups, and each second group comprises two or more second display positions. In this example, the plurality of second display position groups are represented by reels, and the game is played by spinning reels containing the second symbols and stopping the reels so as to display at least one second symbol on each reel.

In this example, the selection carried out by the symbol selectors 20 and 22 is made using one or more random number generators 21 and 23.

In an example, the first base game and the second base game have the same number of reels and present the same number of symbols when the reels stop spinning. The first base game may be displayed adjacent the second base game. In another example, the first and second base games may have the same number of reels, but may have a different number of associated display positions and therefore a different number of displayed symbols when the reels stop spinning.

The memory 42*a* is associated with the first game and is arranged to store first symbols data 14*a* indicative of a plurality of first game symbols. The memory 42*a* also includes first game functions 16*a* and game instruction data 18*a* indicative of first game instructions usable by the gaming machine 10 to control operation of the first game, including win lines data indicative of available win lines for the first game.

The memory 42*b* is associated with the second game and is arranged similarly to the memory 42*a* of the first game, with like components including second game symbols data 14*b*, second game functions 16*b* and second game instructions.

It will be appreciated that instead of having separate memory and components for implementing the first game and the second game, the first and second games may share components including the symbol selector and memory.

It will be appreciated that each of the random number generators 21 and 23 may be of a type which is arranged to generate pseudo random numbers based on a seed number, and that in this specification the term "random" will be understood accordingly to mean truly random or pseudo random.

In this embodiment, the game controller 32 also comprises a trigger determiner 44 arranged to determine whether a trigger condition exists in the plurality of base games. If a trigger condition exists, special game mode commences that may involve implementation of one or more feature games or award of a prize. In this example, if the trigger condition is satisfied, special game mode is implemented by a special game mode implementer 24. Special game mode may involve implementation of one or more feature games and/or may involve implementation of a selection game usable to determine which of a plurality of feature games to implement.

The trigger determiner is in communication with both symbol selectors 20 and 22 and, in this example, the trigger condition is defined to occur when a special combination of symbols occurs across the selected first and second game symbols.

The trigger condition may be for example based on a special symbol combination whereby at least one special symbol from either the first game or the second game is displayed in defined reels of the first and second base games.

The game controller 32 also comprises an outcome evaluator 26. The outcome evaluator 26 determines separate game outcomes of the first and second base games, and game outcomes of the feature games. Accordingly, the first base game may result in a winning outcome independently of the outcome of second base game, and vice versa.

The game controller 32 also comprises a prize allocator 29 arranged to allocate a prize to a player when a winning outcome exists.

In this example, the gaming system is operable in normal game mode and special game mode. During normal game mode, the outcome evaluator 26 determines whether a standard winning symbol combination of either the first base game or the second base game (or both) exists, and a prize is awarded to a player for a standard winning symbol combination. During special game mode, a feature game is implemented by a feature game implementer.

Special game mode is triggered based on game outcomes of the first and second base games. Special game mode may involve implementation of a simple picks game, wherein a plurality of feature symbols are displayed to the player for the player to choose, and each feature symbol corresponds to a feature game or directly to a prize. It will be understood that a number of different feature games may be provided in the picks game.

In the embodiment described below, the symbol selectors 20 and 22, the special game mode implementer 24, the trigger determiner 44, the outcome evaluator 26, and the prize allocator 46 are at least partly implemented using the processor 40 and associated software although it will be understood that other implementations are envisaged.

The gaming system 10 can take a number of different forms.

In a first form, a player operable gaming device in the form of a stand-alone gaming machine is provided wherein all or most components required for implementing the game are present in the gaming machine.

In a second form, a distributed architecture is provided wherein some of the components required for implementing the game are present in a player operable gaming device and some of the components required for implementing the game are located remotely relative to the gaming device. For example, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a device server and the respective functions of the gaming machine and the gaming server are selectively modifiable. For example, the gaming system may operate in stand-alone gaming machine mode, "thick client" mode or "thin client" mode depending on the game being played, operating conditions, and so on. Other variations will be apparent to persons skilled in the art.

Figure 3:
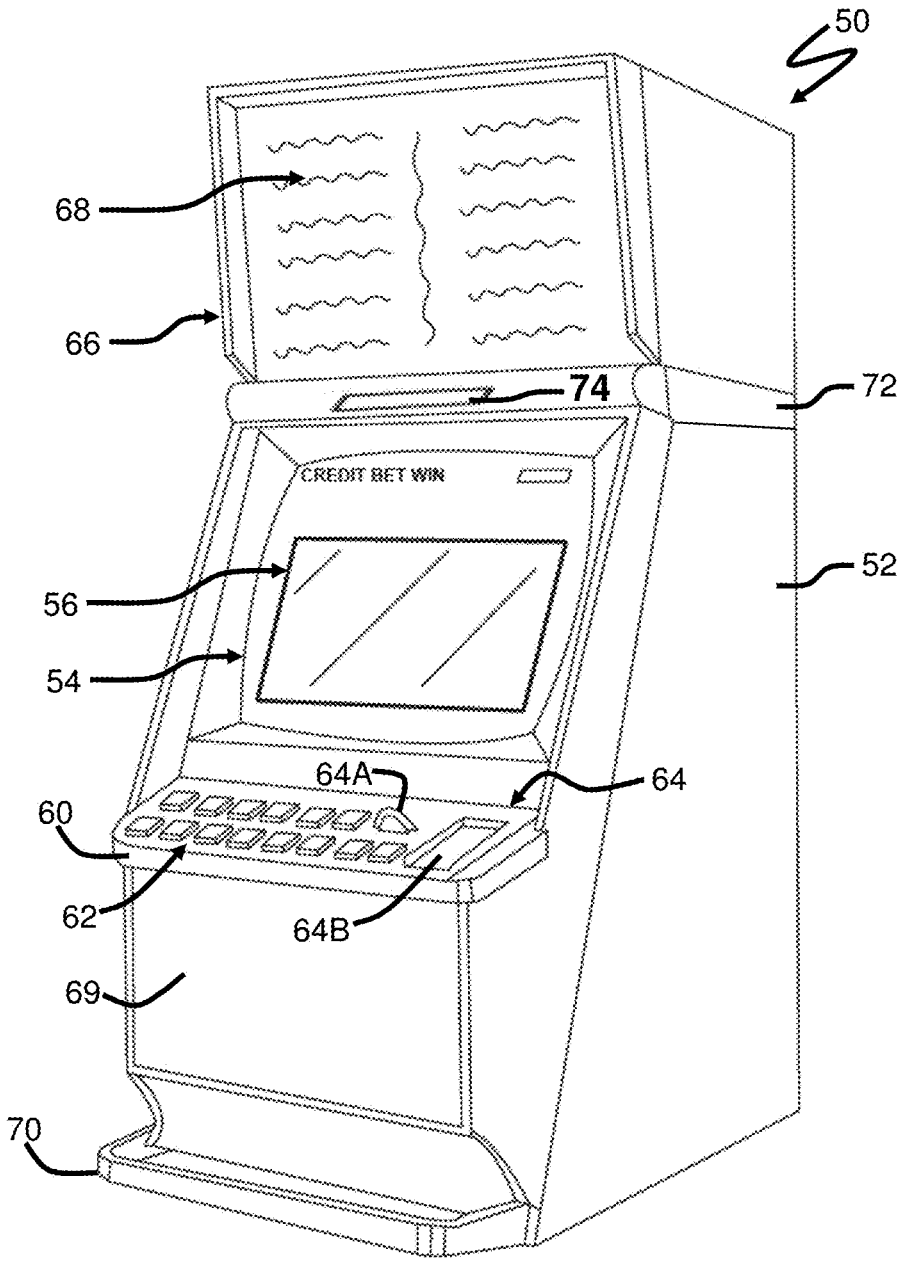
FIG. 3 is a diagrammatic representation of a gaming system in accordance with an embodiment of the present invention with the gaming system implemented in the form of a stand-alone gaming machine.

A gaming system in the form of a stand-alone gaming machine 50 is illustrated in FIG. 3. The gaming machine 50 includes a console 52 having a display 54 on which is displayed representations of a game 56 that can be played by a player. A mid-trim 60 of the gaming machine 50 houses a bank of buttons 72 for enabling a player to interact with the gaming machine, in particular during gameplay. The mid-trim 60 also houses a credit input mechanism 64 which in this example includes a coin input chute 64A and a bill collector 64B. Other credit input mechanisms may also be employed, for example, a card reader for reading a smart card, debit card or credit card.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 69 for dispensing cash payouts from the gaming machine 50.

The display 54 is in the form of a video display unit, particularly a cathode ray tube screen device. Alternatively, the display 54 may be a liquid crystal display, plasma screen, or any other suitable video display unit. The top box 66 may also include a display, for example a video display unit, which may be of the same type as the display 54, or of a different type. The display 54 may comprise a touch screen usable by a player to interact with the gaming machine, in particular during game play.

The display 54 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols. During normal game mode, several base games are implemented and as such multiple sets of reels are displayed.

A player marketing module (PMM) 72 having a display 74 is connected to the gaming machine 50. The main purpose of the PMM 72 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 4:
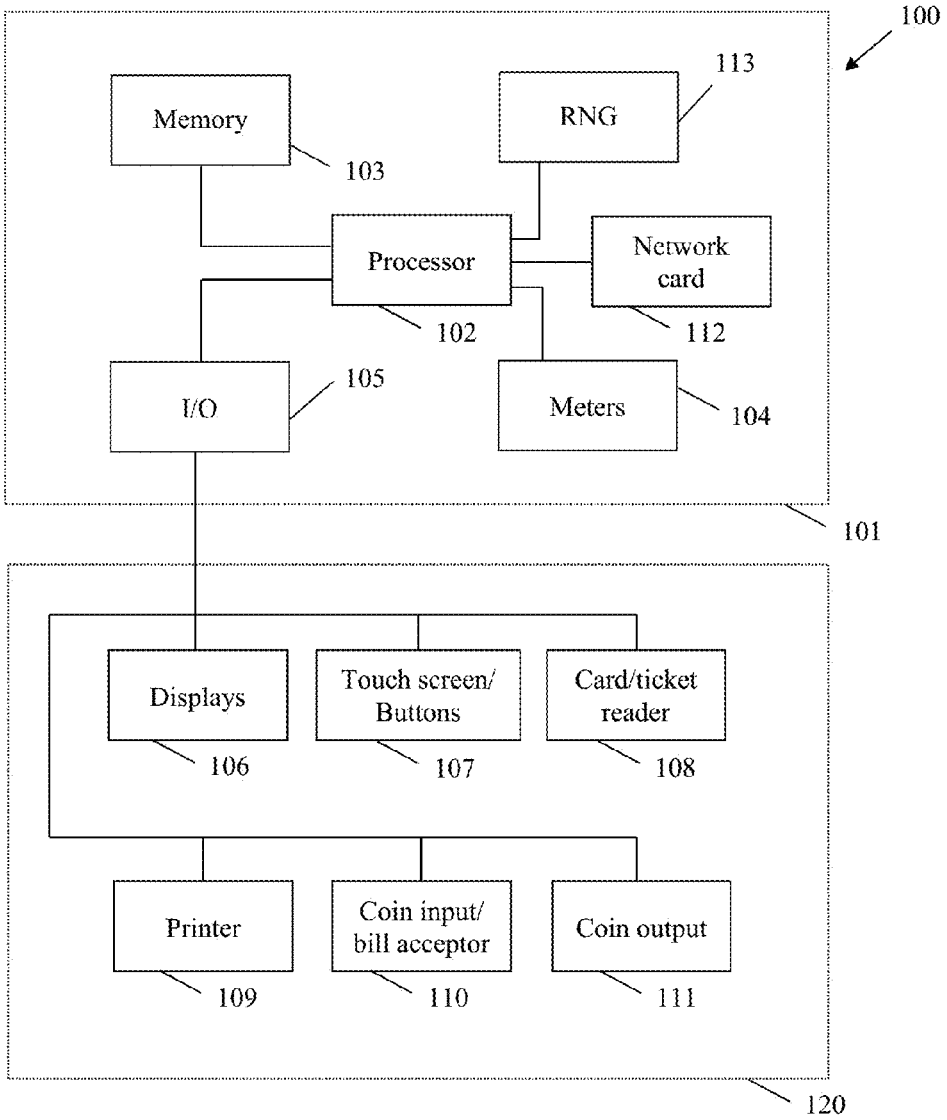
FIG. 4 is a schematic block diagram of operative components of the gaming machine shown in FIG. 3.

FIG. 4 shows a block diagram of operative components of a gaming device 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
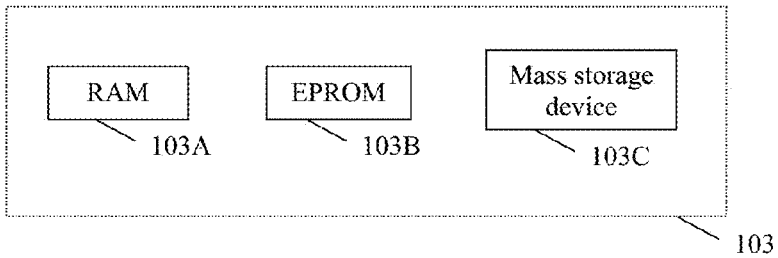
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 6:
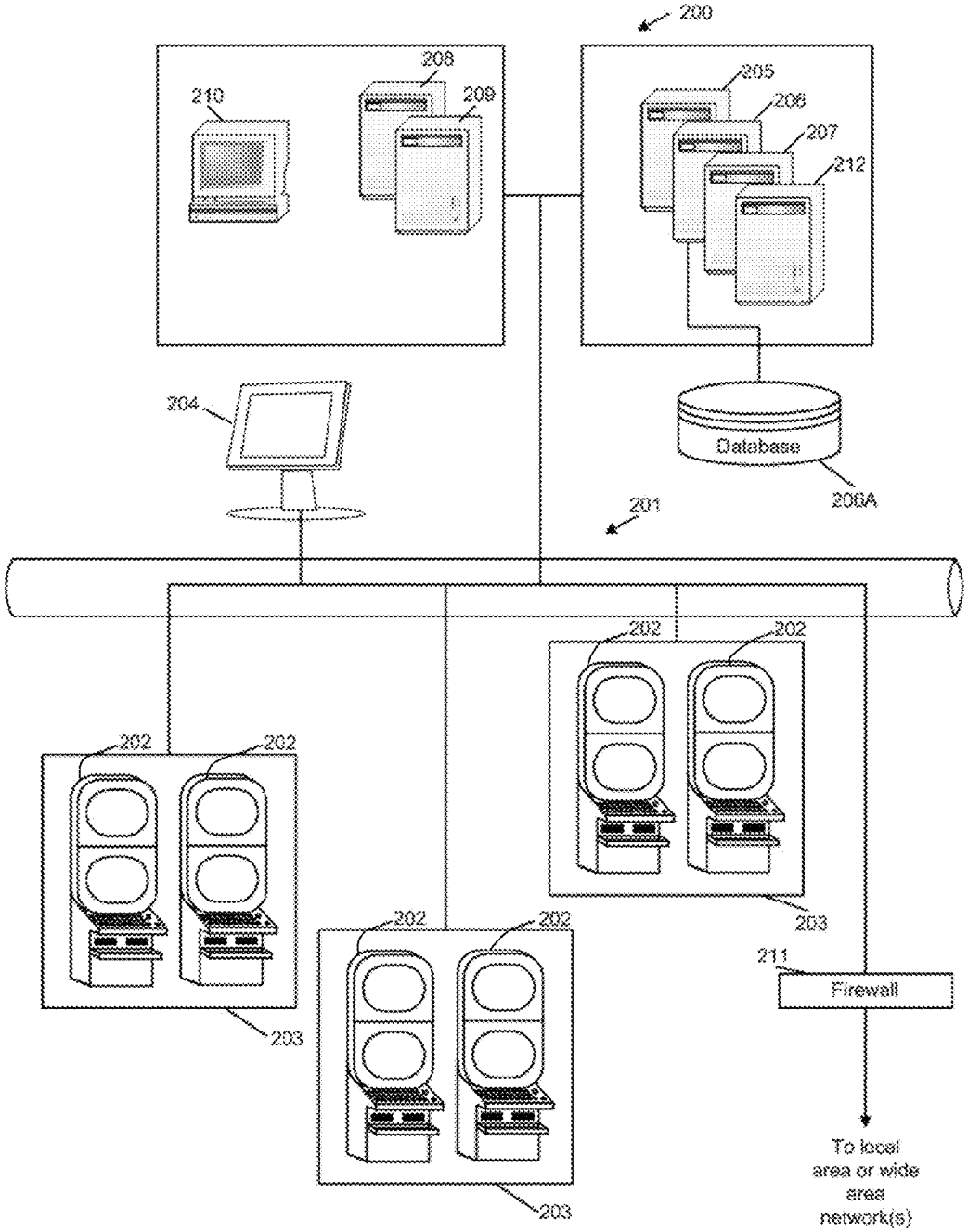
FIG. 6 is a schematic diagram of a gaming system in accordance with an alternative embodiment of the present invention wherein the gaming system is implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40, 100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

Examples of specific implementations of the gaming system will now be described in relation to a stand-alone gaming machine 50 although it will be understood that implementation may also be carried out using other gaming system architectures such as a network architecture of the type shown in FIG. 6.

In this example, the gaming system implements first and second base games which may be implemented concurrently. It will be understood however that more than two games may be implemented. In addition, instead of implementing the base games concurrently, the base games may be implemented consecutively with, for example, the outcomes of both base games displayed together.

Each reel corresponds to a display position group having an associated set of display positions for displaying symbols. In this example, the reels of the first base game include symbols unique to the first base game. Likewise, in this example the reels of the second base game include symbols unique to the second base game. The number of symbols displayed in the reels of the first game may be different to those of the second game. For instance, the first game may be a 3 by 5 reel game (5 reels and 3 symbols displayed in each reel), while the second game may be a 4 by 5 reel game.

The reels are arranged to display standard symbols and one or more function symbols. Win outcomes are determined on the basis of the symbols visible at the display positions when the reels stop rotating.

Typically, a player will purchase or otherwise obtain win entitlements such as several win lines which are used in each base game to determine win outcomes. If the displayed symbols on the reels have symbols associated with a winning combination such as a winning combination disposed on a win line, the player wins a prize.

The number of win lines of the first base game may be different to the number of win lines of the second base game. For example, the first base game may have 25 win lines while the second base game may have 40 win lines.

The gaming system is operable in normal game mode and special game mode and may be arranged to commence special game mode when a predetermined game outcome occurs. Special game mode may comprise one or more feature games.

Special game mode commences automatically on the basis of a combined outcome of the first game and the second game satisfying a trigger condition.

The gaming system 10 may also be arranged so as to determine eligibility for special game mode, for example based on the amount or type of bet placed, based on particular time periods and so on.

Figure 7:
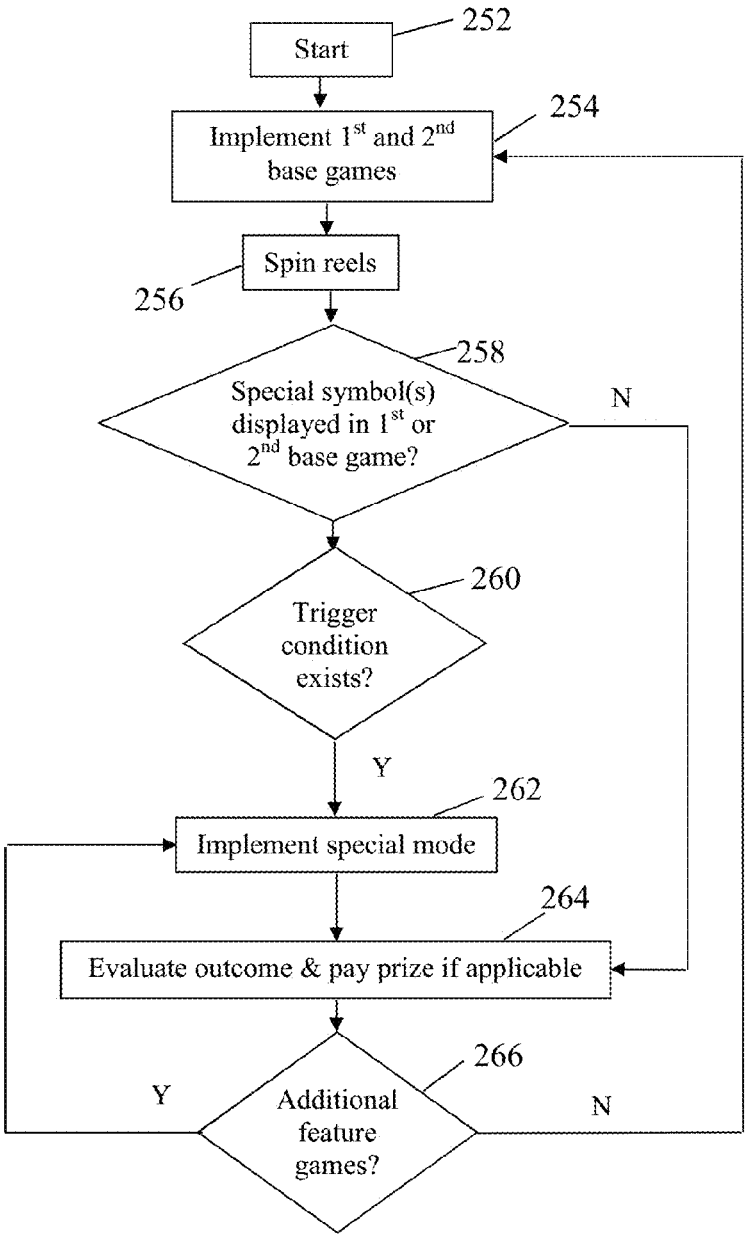
FIG. 7 is a flow diagram illustrating game play of a gaming system in accordance with an embodiment of the present invention.

A specific example will now be described with reference to FIGS. 7 to 11. FIG. 7 shows a flow diagram 250, which illustrates steps 252 to 266 of a method of gaming implemented by the gaming system according to the present embodiment.

Figure 8:
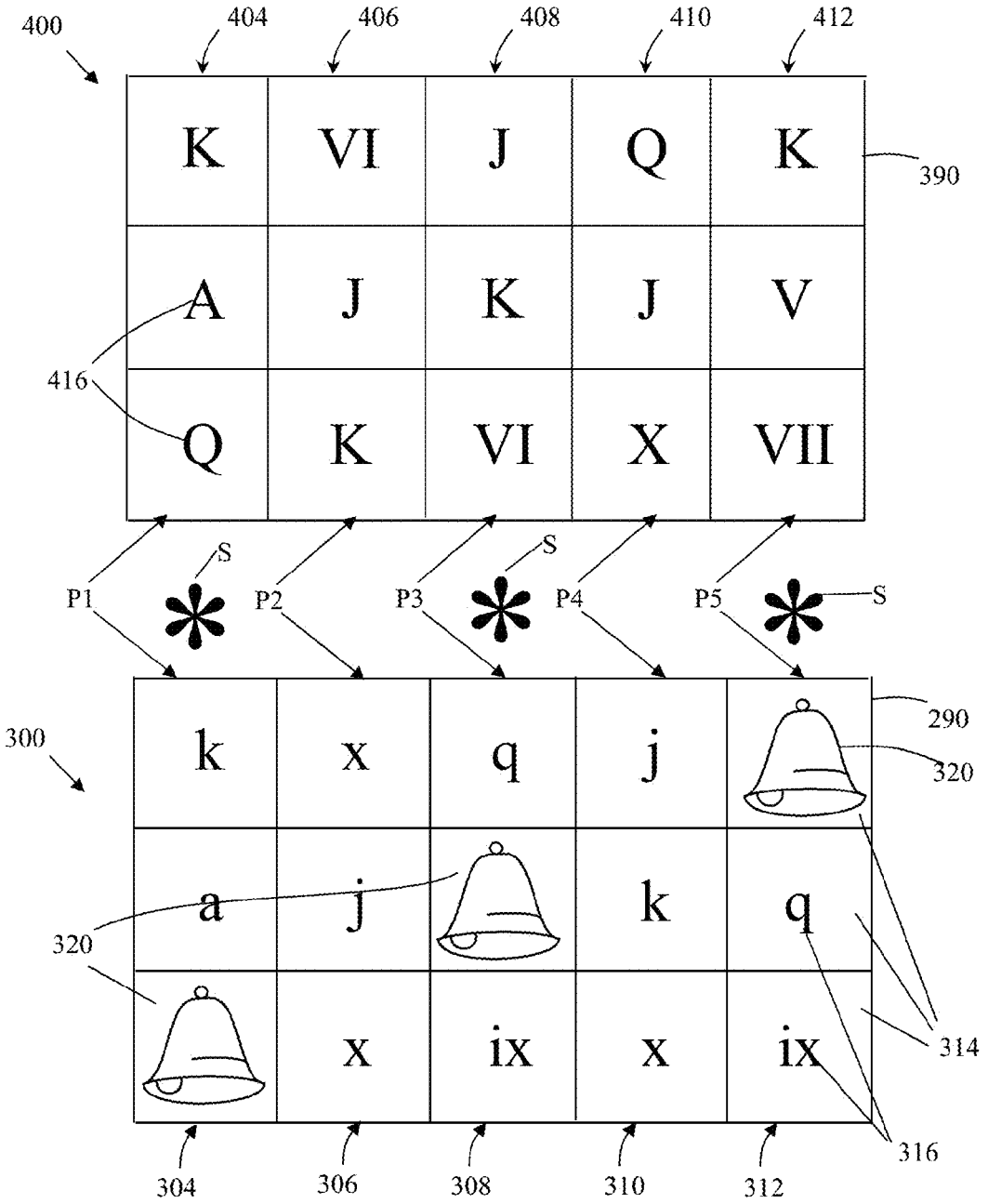
FIGS. 8 to 11 are diagrammatic representations of screens displayed by a gaming system in accordance with embodiments of the present invention.
Figure 9:
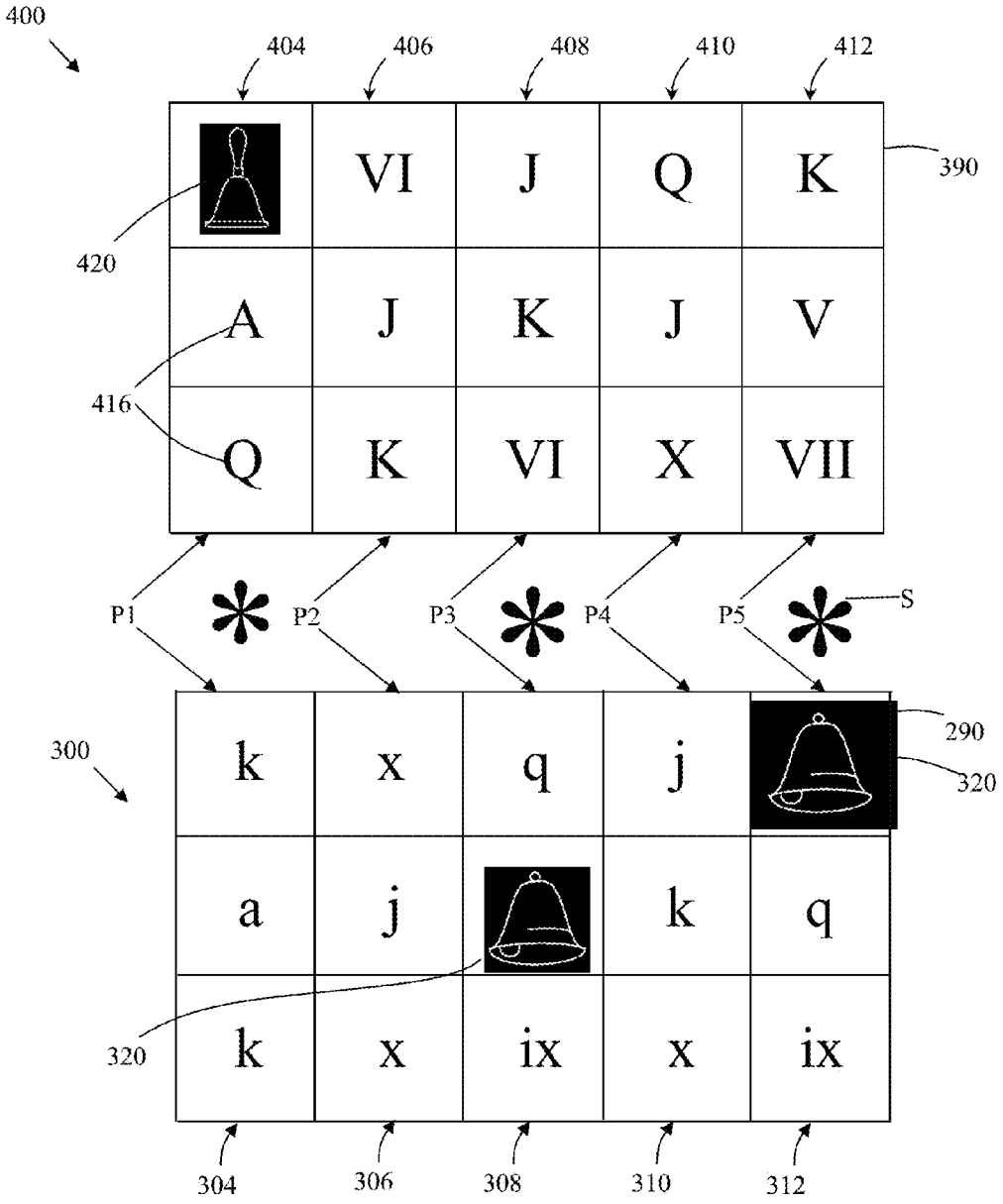
Figure 10:
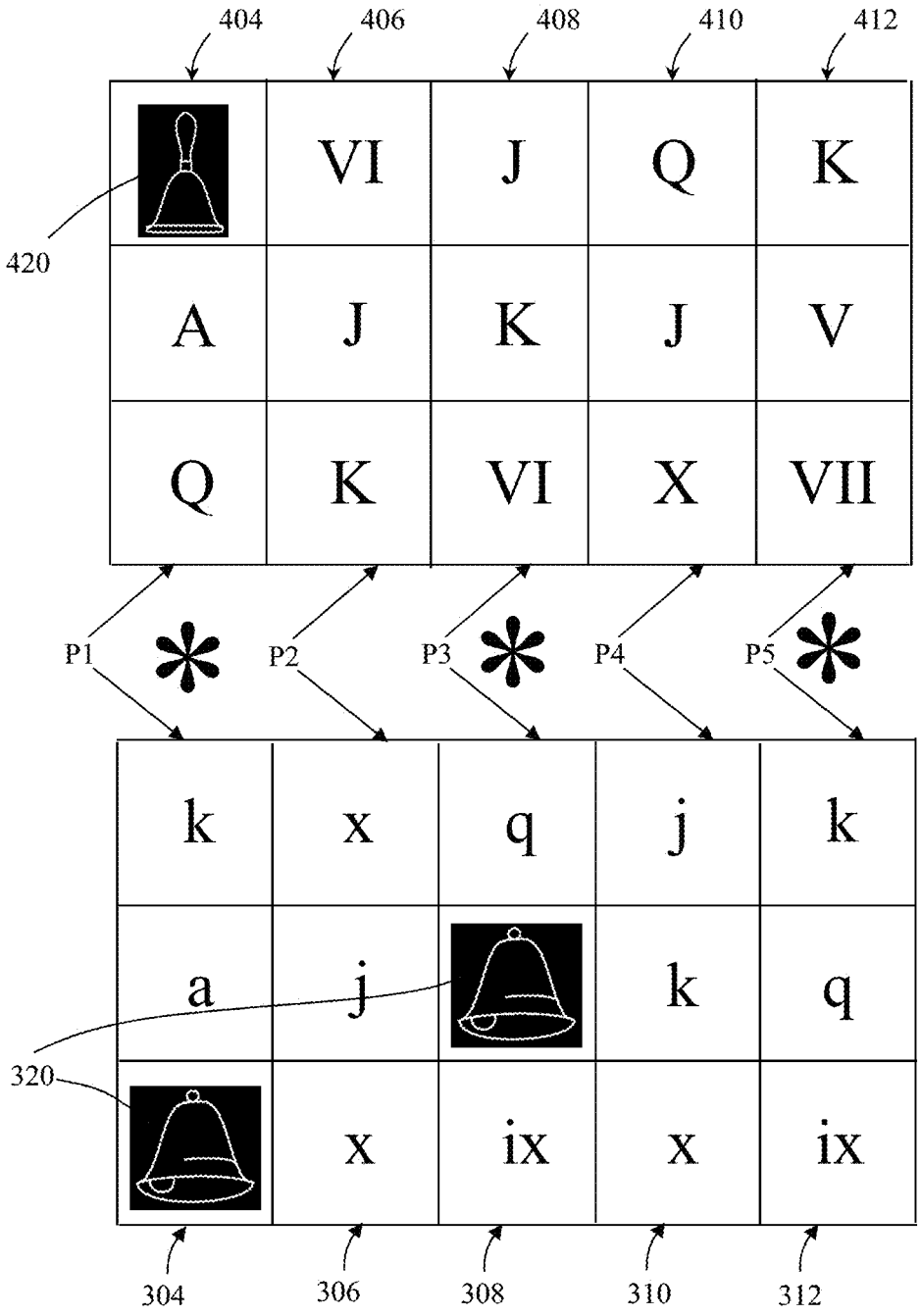

Multiple base games are implemented, in this example a first base game 300 and a second base game 400 using virtual reels, as shown in FIGS. 8 to 10.

In a specific example shown in FIGS. 8 to 10, five virtual reels 304, 306, 308, 310 and 312 are provided and displayed for the first base game on a graphical display device 54 in a display area 290. Each reel 304, 306, 308, 310 and 312 corresponds to a display position group, and each reel comprises three display positions 314 for displaying symbols 316. It will be understood that any number of reels may be provided. Similarly, in this example, the second base game 400 also has five virtual reels 404, 406, 408, 410 and 412 that are displayed on the graphical display device 54 in a display area 390 above the first base game 300.

During implementation of the first and second base games in step 254, the reels are spun in step 256, and subsequently stopped to show a plurality of first symbols 316 in the display area 290 of the first base game 300 and a plurality of second symbols 416 in the display area 390 of the second base game 400.

The two base games may be played concurrently, as shown in FIGS. 8 to 10, although other implementations are envisaged. For example, the first base game may be implemented before the second base game and game outcomes for both base games displayed together.

In this example, the reels are aligned, such that reel 304 is aligned with reel 404, reel 306 is aligned with reel 406, reel 308 is aligned with reel 408, and so forth. The aligned reels may also be functionally paired in that a trigger condition may depend on defined symbols being displayed in at least one display position of one or more pairs of reels P1, P2, P3, P4 and P5.

When the reels of both the first base game 300 and second base game 400 are spun 262 and stopped, the displayed symbols in the two base games are separately evaluated for any standard winning combinations and if any winning combinations exist in the separate base games a prize is awarded.

Determinations of winning combinations can be made by comparing the symbols displayed at the display positions with a pay table or similar.

Standard winning symbol combinations may include common poker game winning combinations such as three of a kind, four of a kind, straights, flushes etc. A standard symbol winning combination may be achieved if symbols that form part of the standard winning combination are displayed at defined display positions on the reels.

In a further embodiment, if a special first game symbol 320 and a special second game symbol are displayed in the same reel pairing, as shown in FIG. 10, those symbols may be replaced with WILD symbols. This may occur regardless of whether a trigger condition 260 is satisfied.

In the above example, each display position group is associated with a reel. However, it will be appreciated that the display position groups may be arranged in any suitable way, and need not be on the same reel or grouped sequentially.

The trigger determiner 44 determines whether a trigger condition is defined in the game outcomes of the first and second base games, and in this example a trigger condition occurs when special symbols are displayed in defined reel pairings.

In a specific example with reference to FIGS. 8 and 9, the trigger condition is based on at least one of a special first game symbol 320 and a special second game symbol 420 being displayed in at least one display position in predetermined reel pairings P1, P3 and P5.

Accordingly, in this example, for the purpose of defining a trigger condition, the reel pairs include a first reel 304 of the first base game 300 paired with a first reel 404 of the second base game 400, a third reel 308 of the first base game 300 paired with a third reel 408 of the second base game 400, and a fifth reel 312 of the first base game 300 paired with a fifth reel 412 of the second base game 400. In order to indicate to a player which reel pairings will be used to determine a trigger condition, indicators "S" are displayed between the first game 300 and the second game 400 adjacent the designated reel pairs.

In the present example, in order to satisfy the trigger condition, at least one special symbol 320 or 420 must be displayed in each of the designated reel pairings P1, P3 and P5. As illustrated in FIGS. 8 and 9, the trigger condition may be satisfied by display of special symbols, whether the special symbols 320, 420 are displayed in the designated reels in one base game or both base games.

It will be understood that any combination or number of reel pairings may be defined for the purposes of the trigger condition.

If the trigger condition based on a special combination of first game symbols and second game symbols exists 260, special game mode is triggered.

During special game mode, a defined feature game may be implemented, or a selection game may be implemented that facilitates selection by a player or the gaming system of the feature game that is implemented. One or more feature games may be implemented. The outcome of the feature game(s) is then evaluated 274 and one or more prizes are allocated to the player if applicable.

As previously mentioned, if the trigger condition 260 does not exist, the outcome of the first game 300 and second game 400 is still evaluated for any standard winning combinations and one or more prizes allocated if applicable.

It will be understood that different types of feature games may be implemented. The type of feature game triggered may depend on the trigger condition satisfied or on the progress status of the particular player through one or more game sessions.

Figure 11:
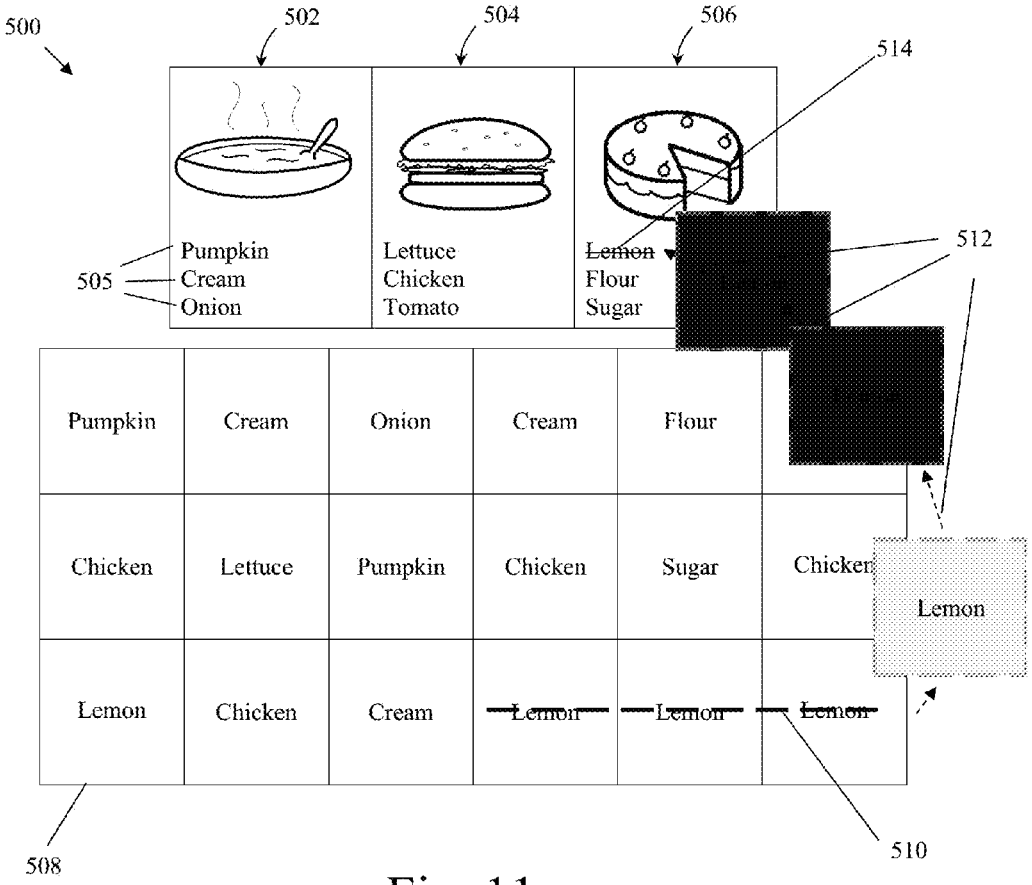

In an example, a feature game 500 as illustrated in FIG. 11 is implemented. In this feature game, a 3 by 6 reel arrangement 508 is implemented. Three targets 502, 504 and 506 are displayed above the reels 508 and each target shows a number of elements 505 to be "collected" by spinning the reels. Each element 505 is considered to be collected when a defined win line including a defined number of the element 505 occurs.

In this specific example, the targets are represented by recipes 502, 504, 506, and the elements are ingredients 505 associated with each recipe. When a particular number of ingredient symbols (in this example lemon) is displayed on a defined win line 510, an animated representation of the ingredient moves across the display in an animated manner from the reels 508 towards the ingredient in the recipe 506, as shown by movement lines 512. When the ingredient reaches the target the ingredient is indicated as collected 514 on the recipe.

When all elements 505 in a recipe 502, 504 or 506 have been collected, the recipe is considered to be completed and an associated prize is awarded.

It will be appreciated that different types of targets, elements and/or animated movement may be employed.

Other feature games may include simple picks games wherein items are displayed for the player to choose, the items being associated with a prize or correspond to a feature game. In one example, a picks game may involve touring through a virtual house or other virtual surroundings to find and pick items.

Another example of a feature game involves one or more wheels that spin and stop to determine a feature game outcome. Each wheel has a plurality of segments with each segment containing information indicative of a potential game outcome, and an indicator is provided for each wheel to indicate a selected segment of the wheel when the wheel stops. In the present example, a plurality of vertically aligned wheels are provided. Each wheel is spun by the player and eventually stops with the respective indicator indicating a particular segment of the wheel. In one example, initially, only the bottom wheel is activated. However, the segment of the bottom wheel indicated by the respective indicator may confer an award or unlock another wheel, such as the wheel immediately above the bottom wheel. In one example, newly unlocked wheels may spin immediately after being unlocked. The top wheel may offer awards of higher value than the other wheels.

In another example, the feature game is a progressive game wherein a player is provided with the opportunity to win a prize amount from a jackpot pool that may be common to a plurality of gaming machines.

Either or both of the first base game 300 and the second base game 400 may be equipped with other features in addition to standard winning combinations and feature game triggers. For example, the base game(s) may have a growing feature to increase the number of winning lines. In a situation where both the first and second base games are implemented, the number of winning lines may increase together so that one will not overtake the other.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such reference does not constitute an admission that the prior art forms a part of the common general knowledge in the art, in Australia or any other country.

Modifications and variations as would be apparent to a skilled addressee are determined to be within the scope of the present invention.

The invention claimed is:

1. A gaming system comprising:

a credit input mechanism configured to receive a physical item associated with a monetary value for establishing a credit balance, said credit balance being increasable and decreasable based at least on wagering activity;

a display comprising a first display area and a second display area, said first display area including a first plurality of reels, each providing a plurality of first display positions, said second display area including a second plurality of reels, each providing a plurality of second display positions, wherein a first reel of said first plurality of reels is paired with a second reel of said second plurality of reels to form a reel pairing; and a game controller configured to, in accord with having established said credit balance via said credit input mechanism receiving said physical item, implement a first base game in said first display area, said game controller configured to select, from a first set of first symbols, a plurality of first symbols for said first base game, said plurality of first symbols being displayed in said plurality of first display positions provided by said first plurality of reels;

wherein said game controller is further configured to, in accord with having established said credit balance via said credit input mechanism receiving said physical item, implement a second base game in said second display area, said game controller configured to select, from a second set of second symbols, a plurality of second symbols for said second base game, said plurality of second symbols being displayed in said plurality of second display positions provided by said second plurality of reels; and wherein said game controller is further configured to evaluate the reel pairing to determine that a trigger condition is satisfied in response to any one of said plurality of first display positions of the first reel or any one of said plurality of second display positions of the second reel respectively displaying a defined first symbol or a defined second symbol.

2. The gaming system of claim 1, wherein the first symbols of the first set are different from the second symbols of the second set.

3. The gaming system of claim 1, wherein a further trigger condition is based on display of a defined symbol combination combined across the first and second display areas of the first and second base games.

4. The gaming system of claim 1, wherein a further trigger condition is based on display of defined symbols at defined display positions of the first and second base games.

5. The gaming system of claim 4, wherein the defined display positions correspond to a scatter pattern.

6. The gaming system of claim 1, wherein a further trigger condition is satisfied when both:

any first display position of the first reel displays the defined first symbol; and any second display position of the second reel displays the defined second symbol.

7. The gaming system of claim 6, wherein in response to the trigger condition, the game controller is further configured to replace the defined first symbol and the defined second symbol with a WILD symbol.

8. The gaming system of claim 1, wherein said game controller is further configured to implement a game event in response to determining that the trigger condition has been satisfied.

9. The gaming system of claim 8, wherein in response to the game event, the game controller is further configured to implement a special game mode that includes at least one feature game.

10. The gaming system of claim 1, wherein:

a third reel of said first plurality of reels is paired with a fourth reel of said second plurality of reels to form a second reel pairing; and said game controller is further configured to determine that the trigger condition is satisfied in response to any one of said plurality of first display positions of the third reel or any one of said plurality of second display positions of the fourth reel respectively displaying the defined first symbol or the defined second symbol.

11. The gaming system of claim 1, wherein an indicator is displayed between the first reel and second reel to indicate the first reel is paired with the second reel.

12. The gaming system of claim 1, wherein:

a third reel of said first plurality of reels is paired with a fourth reel of said second plurality of reels to form a second reel pairing;

a first indicator is displayed between the first reel and second reel to indicate the first reel is paired with the second reel; and a second indicator is displayed between the third reel and the fourth reel to indicate the third reel is paired with the fourth reel.

13. A method of gaming for use with a gaming machine having a credit input mechanism configured to receive a physical item associated with a monetary value for establishing a credit balance, the credit balance being increasable and decreasable based at least on wagering activity, a display comprising a first display area and a second display area, said first display area including a first plurality of reels, each providing a plurality of first display positions, said second display area including a second plurality of reels, each providing a plurality of second display positions, wherein a first reel of said first plurality of reels is paired with a second reel of said second plurality of reels to forma a reel pairing, the method comprising:

initiating, via the game controller, in accord with having established the credit balance via the credit input mechanism receiving the physical item, play of a first base game in said first display area;

selecting, via the game controller, a plurality of first symbols from a first set of first symbols for the first base game;

displaying said plurality of first symbols in the plurality of first display positions provided by said first plurality of reels;

initiating, via the game controller, in accord with having established the credit balance via the credit input mechanism receiving the physical item, play of a second base game in said second display area;

selecting, via the game controller, a plurality of said second symbols from a second set of second symbols for the second base game;

displaying said plurality of said second symbols in the plurality of second display positions provided by said second plurality of reels; and evaluating the reel pairing to determine that a trigger condition is satisfied in response to any one of said plurality of first display positions of the first reel or any one of said plurality of second display positions of the second reel respectively displaying a defined first symbol or a defined second symbol.

14. The method of claim 13, wherein the first symbols of the first set are different from the second symbols of the second set.

15. The method of claim 13, further comprising determining that the trigger condition is satisfied in response to a defined symbol combination combined across the first and second display areas of the first and second base games.

16. The method of claim 13, further comprising determining that the trigger condition is satisfied in response to defined symbols displayed at defined display positions of the first and second base games.

17. The method of claim 16, wherein the defined display positions correspond to a scatter pattern.

18. The method of claim 13, further comprising replacing said defined first symbol and said defined second symbol with a WILD symbol in response to determining that the trigger condition is satisfied.

19. The method of claim 13, further comprising implementing a game event, via the game controller, in response to determining that the trigger condition is satisfied.

20. The method of claim 19, further comprising in response to the game event, implementing, via the game controller, a game mode that includes at least one feature game.

21. The method of claim 13, wherein:

a third reel of said first plurality of reels is paired with a fourth reel of said second plurality of reels to form a second reel pairing; and the method further comprises determining that the trigger condition is satisfied in response to any one of said plurality of first display positions of the third reel or any one of said plurality of second display positions of the fourth reel respectively displaying the defined first symbol or the defined second symbol.

22. The method of claim 13, further comprising displaying an indicator between the first reel and second reel to indicate the first reel is paired with the second reel.

23. The method of claim 13, wherein:

a third reel of said first plurality of reels is paired with a fourth reel of said second plurality of reels to form a second reel pairing; and the method further comprises displaying a first indicator between the first reel and second reel to indicate the first reel is paired with the second reel, and displaying a second indicator between the third reel and the fourth reel to indicate the third reel is paired with the fourth reel.

* * * * *